United States Patent [19]

Ozaki et al.

[11] Patent Number: 4,954,102

[45] Date of Patent: Sep. 4, 1990

[54] WIRING CONNECTION APPARATUS

[75] Inventors: Keiichi Ozaki; Naoki Manabe; Tatsumi Shibata; Hideharu Hayashi; Yukio Muramatsu; Masaki Yamamoto, all of Shizuoka, Japan

[73] Assignee: Yazaki Corporation, Japan

[21] Appl. No.: 327,056

[22] Filed: Mar. 22, 1989

[30] Foreign Application Priority Data

Mar. 25, 1988 [JP] Japan ..... 63-69824

[51] Int. Cl.[5] ..... H01R 13/00

[52] U.S. Cl. ..... 439/535; 439/34

[58] Field of Search ..... 174/72 A; 439/34, 35, 439/362, 364, 533, 540

[56] References Cited

U.S. PATENT DOCUMENTS 4,815,984 3/1989 Sugiyama et al. ..... 174/72 A X

*Primary Examiner*—Eugene F. Desmond

*Attorney, Agent, or Firm*—Sughrue, Mion, Zinn Macpeak & Seas

[57] ABSTRACT

A wiring connection apparatus is disclosed in which an electric connection box connected to connectors of terminals of wire harnesses is housed and fixed in a protecting cover. A reception seat for fixing the electric connection box by means of a screw is fixed to the protecting cover. A lock unit is provided between the reception seat and the connectors of the terminals of the wire harnesses so that the electric connection box and the connectors may be simultaneously connected to each other when the electric connection box is fixed to the reception seat by the screw.

9 Claims, 6 Drawing Sheets

WIRING CONNECTION APPARATUS

BACKGROUND OF THE INVENTION

The present invention relates to an improvement in a wiring connection apparatus in which an electric connection box is housed and fixed in a protecting casing, and the casing is arranged to be attached to a car body or the like.

A conventional wiring connection apparatus will be explained with reference to FIG. 1. The apparatus comprises an electric connection box 1, a screw-type multipolar connector 2 connected to terminals of a wire harness W, an ordinary small connector 3 for connecting wire harnesses to each other, a protecting casing 4, and a cover casing 5. The protecting casing 4 is provided with an attachement plate 6 for attaching the protecting casing 4 to a vehicle body, and a lock member 7 and a lock spring 7' for locking the cover casing 5.

In order to fix the electric connection box 1 to the protecting casing 4, a method has been employed, as shown in FIG. 1, in which an assembling worker fastens a fastening bolt 8 inserted into the screw-type multipolar connector 2 with a motor-driven tool such as an impact wrench (not shown) so as to connect the connector 2 to the electric connection box 1 while holding the electric connection box 1 in one hand, and fixes the thus connected electric connection box 1 and the connector 2 to each other. Thereafter, a screw 10 is screwed to reception seats 9 provided in the protecting casing 4. In FIG. 1, reference numeral 8' designates an embedded nut for the fastening bolt 8.

The fixing method for the electric connection box as described above, however, suffers from low workability insufficiency with respect to safety aspect because an assembling worker must use a motor-driven tool while holding the electric connection box by his hand, and a wire harness W has to have a sufficient length L (extra-length for working) for performing the work for connecting the screw-type multipolar connectors. Therefore it is necessary to make the protecting casing large in size so as to house the extra-length L.

The present invention has been achieved with regard to recognition of the aforementioned circumstances, and an object thereof is to provide a wiring connection apparatus in which the work for assembling an electric connection box, a connector for wire harness terminals, and a protecting casing can be performed safely and easily, and the extra-length of the wire harness can be minimized.

SUMMARY OF THE INVENTION

In order to achieve the above object, according to the present invention, the wiring connection apparatus in which an electric connection box connected to a connector of terminals of wire harnesses is housed and fixed in a protecting cover, is characterized in that a reception seat for fixing the electric connection box by means of a screw is provided within the protecting cover, and a lock means is provided between the reception seat and the connector of the terminals of the wire harnesses so that the electric connection box and the connector are simultaneously connected to each other when the electric connection box is fixed to the reception seat.

In the case where the wire harness has branched wire harnesses and the branched harnesses are connected to each other through connections between pairs of female and male connectors, lock means are provied between the electric connection box and one of the female and male connectors in each pair and between the other connector in each pair and the protecting cover or the reception seat, so that the connection between the female and male connectors in each pair is carried out at the same time when the electric connection box is fixed to the reception seat.

DESCRIPTION OF THE PREFERRED EMBODIMENTS

Figure 1:
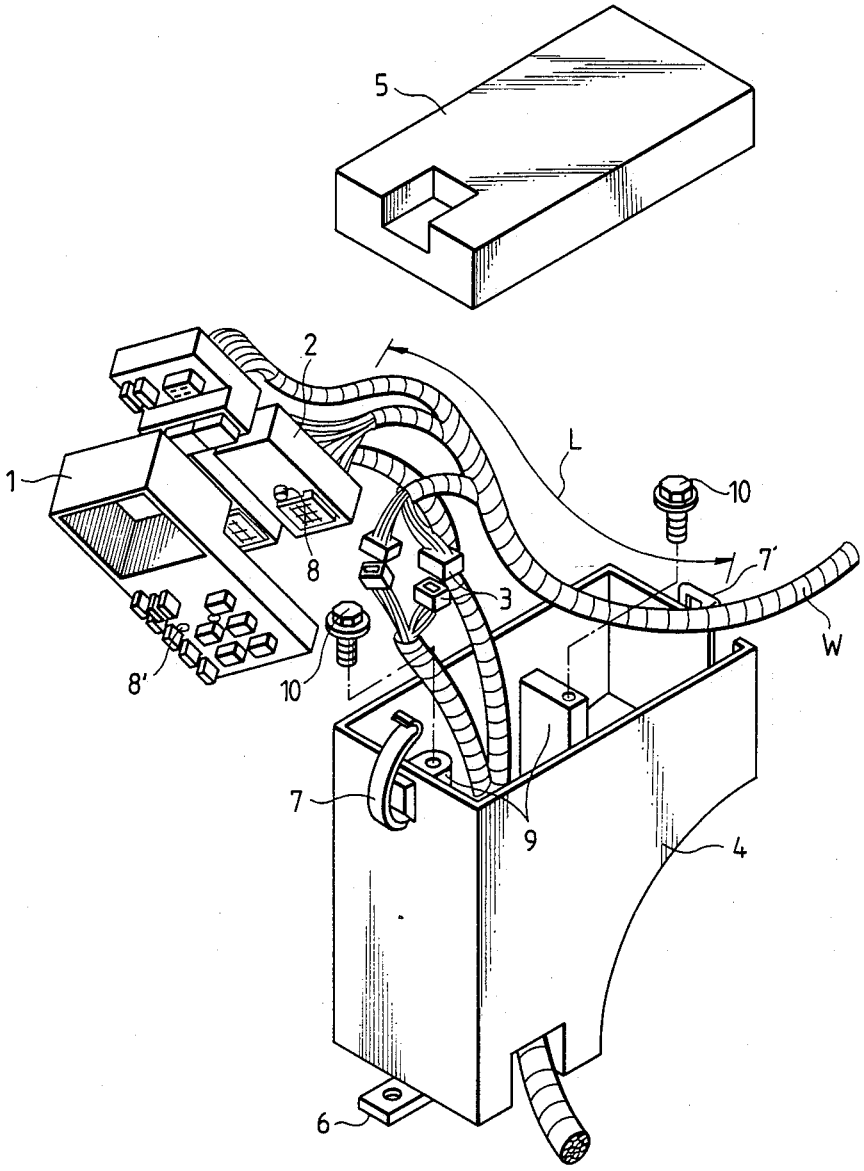
FIG. 1 PRIOR ART
FIG. 1 is an exploded perspective view of a conventional example.

Referring to the drawings, the present invention will now be described. The same constituent parts as those of the conventional example are correspondingly referenced and the description thereof will be partly omitted.

Figure 2:
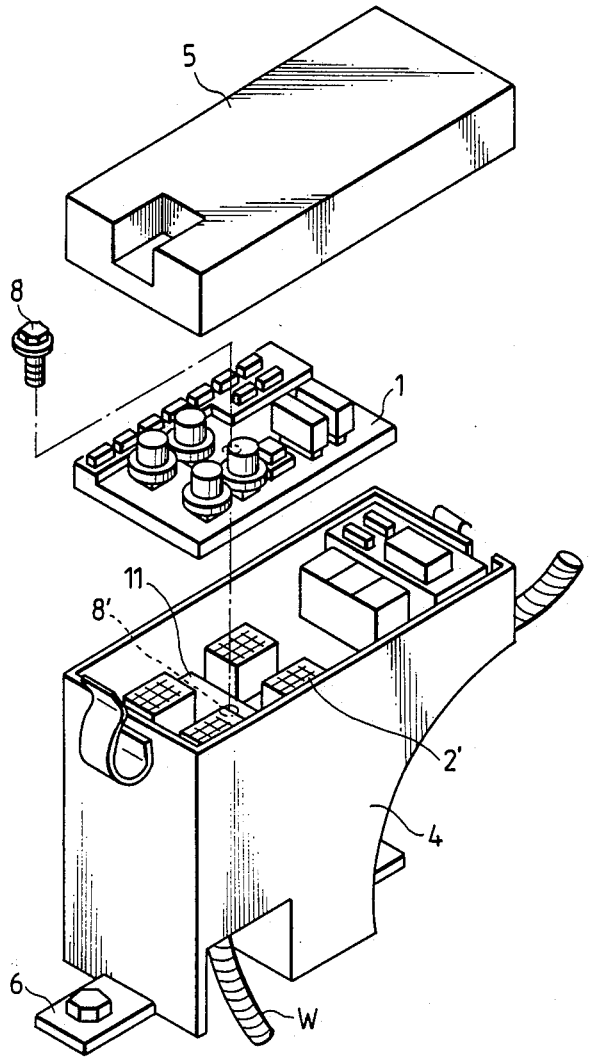
FIG. 2 is an exploded perspective view showing a first embodiment of the wiring connection apparatus.
Figure 3A:
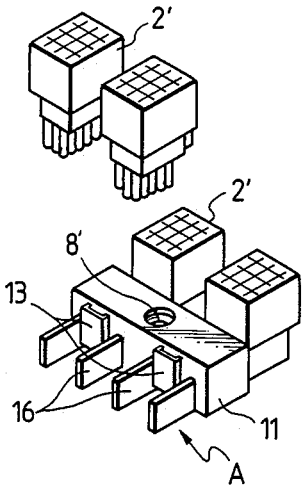
FIGS. 3A and 3B are an enlarged perspective view of a main portion of the apparatus and an enlarged perspective view of a lock plate and a lock band of the same, respectively.
Figure 3B:
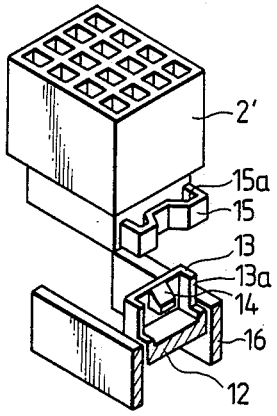
Figure 4:
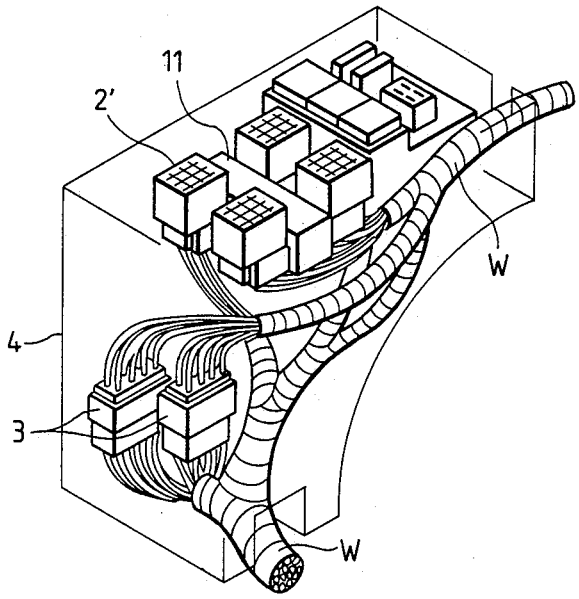
FIG. 4 is a perspective view of the state in which the apparatus is assembled and housed.

FIG. 2 is an exploded perspective view of the wiring connection apparatus according to a first embodiment of the invention. FIGS. 3A and 3B are enlarged perspective views of main portions of the apparatus of FIG. 2, and FIG. 4 is a perspective view showing the state in which the apparatus is assembled and housed.

As shown in the drawings, a reception seat 11 having a nut 8' embedded thererin for fixing an electric connection box 1 with a fastening bolt 8 is provided inside a protecting cover 4. Relatively small-sized multipolar connectors 2' (four in the embodiment) divided from the conventional screw-type connector 2 (see FIG. 1) are connected to the terminals of a wire harness W, and lock means A is provided between a group of the connectors 2' and the reception seat 11.

As shown in FIGS. 3A and 3B, the lock means A is constituted by lock plates 13 projected upward from the side wall of the reception seat 11 through support walls 12, respectively, lock claws 14 formed on the inner surfaces of the respective lock plates 13 so as to project therefrom, and flexible lock bands 15 transversally provided on the lower side walls of the respective multipolar connectors 2'. A projecting strip **13*a* for guiding and positioning the connector 2' in locking the connector 2' and a slot 15*a* corresponding to the projecting strip 13*a* are provided on the lock plate 13 and in the lock band 13, respectively. Reinforcing beams 16 corresponding to the resepective lock plates 13 are projectingly formed on the side walls of the reception seat 11 opposite to the resepective lock plates 13**.

In this configuration, after the protecting casing 4 has been fixed to a bracket (not shown) or the like of a car body by means of a bolt through an attachment plate 6, the connectors 2' attached to the terminals of the wire harness W can be fixed to the reception seat 11 in the protecting casing 4 by means of the lock means A.

That is, pushing the lock band 15 of each of the connectors 2' into the side wall of the reception seat 11 and the lock plate 13, an assembling worker can easily lock the connector 2'. Accordingly, then, the worker will fix the electric connection box 1 onto the connectors 2' by means of the fastening bolt 8 by using a torque wrench or the like. Since each of the connectors 2' is previously positioned by means of the lock means A or by means of the connection of the projecting strip 13*a* and the slot 15*a*, the connectors 2' can be automatically connected to the electric connection box 1 when the electric connection box 1 is fastened by means of the bolt.

Thus, since such an unstable work in which a worker assembles a conventional screw-type connector while having the electric connection box 1 in his hand is made unnecessary, the workability and safety are extremely improved. Further, since the connectors 2' may be housed in the protecting casing 4 before those connectors 2' are connected to the electric connection box 1, it is needless that the wire harness requires a long working extra-length unlike the conventional case, and the wire harness can be compactly housed as shown in FIG. 4 so that the protecting casing 4 can be made small in size.

The lock means A is not limited to such a structure as shown in FIGS. 3A and 3B, but may have any structure so long as it can perform positioning and locking for the connectors 2' to the electric connection box 1.

Figure 5:
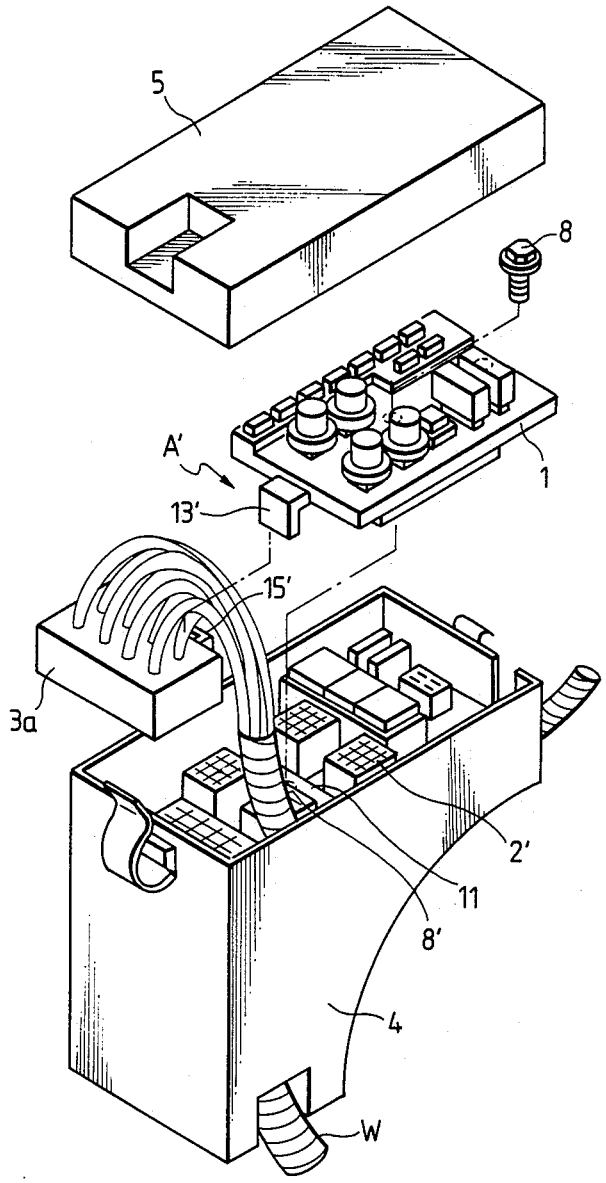
FIG. 5 is an exploded perspective view showing another embodiment of the wiring connection apparatus.
Figure 6:
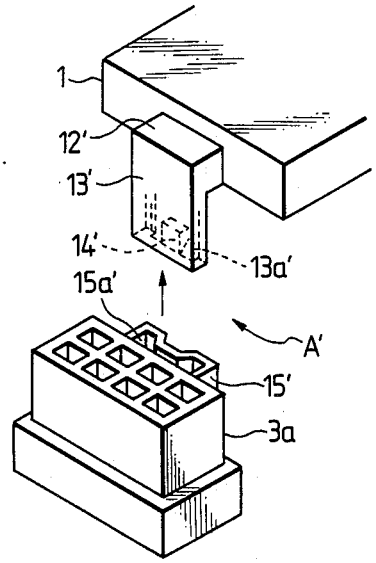
FIG. 6 is an enlarged perspective view showing lock means between an electric connection box and a female connector.
Figure 7:
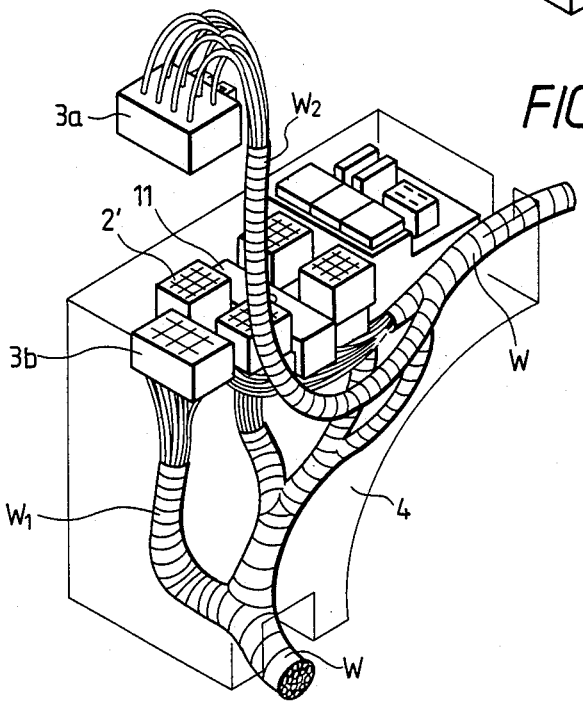
FIG. 7 is a perspective view of the state in which the apparatus is assembled and housed.
Figure 8A:
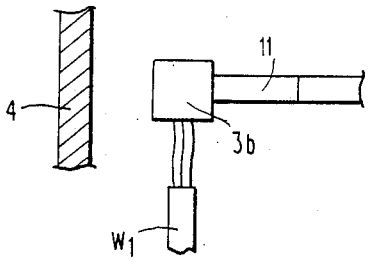
FIG. 8(A) and FIG. 8(B) are further arrangements of the lock means.
Figure 8B:
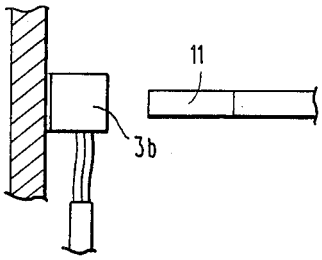

FIGS. 5 through 7 show another embodiment of the invention, in which the work for connecting a pair of female and male connectors 3*a* and 3*b* for connecting each couple of wire harnesses W1 and W2 branched from the respective wire harnesses W can be easily carried out.

That is, lock means A' is provided between the female connector 3*a* and the electric connection box 1, and the same lock means A as that described above is provided between the male connector 3*b* and a reception seat 11.

As shown in FIG. 6, the lock means A' is constituted by a lock plate 13' projected downward from an end wall of the electric connection box 1 through a support wall 12' which is parallel to the end wall, a lock claw 14' projected from the lock plate 13' at its inner surface, and a flexible lock band 15' transversely provided on the female connector 3*a* at its outer circumferential wall. Similarly to the lock means A, projecting strips 13*a'* and slots 15*a'* corresponding to the projecting strips 13*a'* are provided on the lock plates 13' and in the lock bands 14', respectively.

A lock plate 13 (see FIG. 3) for the male connector 3*b* may be provided on a protecting cover 4 at its inner wall in place of the reception seat 11.

According to this embodiment, the female connector 3*a* of each wire harness W1 not-passing through the electric connection box 1 can be previously locked to the electric connection box 1 in the fashion of a cassette system, and the male connector 3*b* of the corresponding wire harness W2 can be previously locked and fixed to the reception seat 11 or to the inner wall of the protecting cover 4. Accordingly, when the electric connection box 1 is fixed on the reception seat 11 by means of a fastening bolt 8, the connection of the electric connection box 1 with the conectors 2' and the connection of the female and male connectors 3*a* and 3*b* can be carried out at the same time. Accordingly, it becomes unnecessary that the female and male connectors 3*a* and 3*b* are manually connected with each other to thereby more improve the workability. Additionally, since the fasterning bolt 8 is mechanically connected by means of a torque wrench or the like, the connectors can be prevented from half-fitting.

As described above, according to the present invention, the work for connecting the connectors at the terminals of the wire harnesses with the electric connection box can be safely and easily carried out so that the workability is extremely improved, and the working extra-length of the wire harnesses can be shortened to thereby make the protecting casing small in size.

We claim:

1. A wiring connection apparatus in which an electric connection box connected to connectors of terminals of wire harnesses is housed and fixed in a protecting cover, said apparatus comprising an improvement wherein a reception seat for fixing said electric connection box is fixed within said protecting cover, and a first lock means is provided between said reception seat and said connectors of the terminals of said wire harnesses so that said electric connection box and said connectors are simultaneously connected to each other when said electric connection box is fixed to said reception seat.

2. The wiring connection apparatus according to claim 1, wherein said electric connection box is fixed to said reception seat using a screw disposed between said electric connection box and said reception seat.

3. The wiring connection apparatus according to claim 1, wherein said first means is for fixing said connectors to said reception seat.

4. The wiring connection apparatus according to claim 3, wherein said first lock means may lock said connectors in place individually.

5. A wiring connection apparatus in which connectors of terminals of wire harnesses are connected to an electric connection box, and wire harnesses which do not pass through said electric connection box are connected to each other by means of pairs of female and male connectors, and said electric connection box, said wire harnesses, and said connectors are housed and fixed in a protecting cover, said apparatus comprising an improvement wherein:

first lock means is provided between said electric connection box and one of said female and male connectors, second lock means are provided between said reception seat and said connectors of the terminals of said wire harnesses, and third lock means is fixedly provided to the other of said female and male connectors, so that when said electric connection box is fixed to said reception seat, the connection between said electric connection box and said connectors of the terminals of said wire harnesses and the connection between said female and male connectors of said wire harnesses are carried out at the same time.

6. The wiring connection apparatus according to claim 5, wherein said electric connection box is fixed to said reception seat using a screw disposed between said electric connection box and said reception seat.

7. The wiring connection apparatus accoriding to claim 6, wherein said second lock means may lock said connectors of said terminal in place individually.

8. The wiring connection apparatus according to claim 5, wherein said third lock means is fixedly provided between the other of the female and male connectors and the reception seat.

9. The wiring connection apparatus according to claim 5, wherein said third lock means is fixed provided between the other of the female and male connectors and the protecting cover.

* * * * *